United States Patent [19]

Iuliano et al.

[11] Patent Number: 5,035,022

[45] Date of Patent: Jul. 30, 1991

[54] DEVICE FOR APPLYING COATINGS TO OBJECTS HAVING IRREGULAR SHAPES AND/OR DIVERSE SURFACES

[76] Inventors: Joseph Iuliano, Rte. 3, 3714 Woodbine Way, Roswell, N. Mex.; Frederick W. Gaines, Jr., 4860 No. F, E. Fort Lowell, Tucson, Ariz.

[21] Appl. No.: 447,634

[22] Filed: Dec. 8, 1989

[51] Int. Cl.[5] ..... B05C 17/02; B05C 21/00

[52] U.S. Cl. ..... 015/118; 15/230.011; 15/145

[58] Field of Search ..... 15/118, 230.11, 145

[56] References Cited

U.S. PATENT DOCUMENTS

| | | | |
|---|---|---|---|
| 2,788,539 | 4/1957 | Santina | 15/230.11 |
| 2,799,884 | 7/1957 | Bedford | 15/230.11 |
| 2,813,292 | 11/1957 | McLendon | 15/230.11 |
| 2,824,328 | 2/1958 | Bedford | 15/230.11 |
| 2,904,813 | 9/1959 | Schleicher | 15/230.11 |
| 3,156,938 | 11/1964 | Bills | 15/230.11 |
| 3,371,767 | 3/1968 | Tigerman | 15/145 |
| 3,562,837 | 2/1971 | Baginski et al. | 15/230.11 |
| 3,649,986 | 3/1972 | Dahlund | 15/230.11 |
| 3,758,312 | 12/1967 | Parr | 15/230.11 |
| 4,257,140 | 3/1981 | Downing | 15/230.11 |
| 4,335,484 | 6/1982 | Ridge et al. | 15/230.11 |
| 4,644,604 | 2/1987 | Kierce | 15/230.11 X |

FOREIGN PATENT DOCUMENTS

| | | | |
|---|---|---|---|
| 525941 | 2/1954 | Belgium | 15/230.11 |
| 80213 | 5/1952 | Denmark | 15/230.11 |
| 2823277 | 11/1979 | Fed. Rep. of Germany | 15/230.11 |
| 3616114 | 11/1987 | Fed. Rep. of Germany | 15/230.11 |
| 25024 | 4/1960 | German Democratic Rep. | 15/230.11 |
| 2172820 | 10/1986 | United Kingdom | 15/230.11 |

*Primary Examiner*—Ernest G. Cusick
*Attorney, Agent, or Firm*—Richard R. Mybeck

[57] ABSTRACT

A device for applying codes and/or coatings to objects having irregular shapes and/or diverse surfaces including a handle assembly having a first, second and third roller mounting assembly secured thereto for presenting roller applicators in three separate planes, one of which is adjustable relative to the other two. The device is adapted for disassembly into a bi-roller and a mono-roller applicator when exigencies require.

17 Claims, 2 Drawing Sheets

DEVICE FOR APPLYING COATINGS TO OBJECTS HAVING IRREGULAR SHAPES AND/OR DIVERSE SURFACES

INTRODUCTION

This invention relates generally to a device for applying coatings to objects having irregular shapes and/or diverse surfaces and more particularly to a multi-purpose device for applying paint, varnish, rust preventative compound, and like substances to fences, pipes, iron work, gutters, downspouts, trim, and other utilitarian or decorative objects having irregular shapes and/or a plurality of diverse surfaces to be coated. Furthermore, the device hereof can be used for material identification with repetitive printed markings by simply replacing the paint roller with a print roller.

BACKGROUND OF THE INVENTION

The coating of fences or other shaped articles, whether decorative or utilitarian in nature, has heretofore presented a myriad of problems to obtain uniform coating particularly when sloped surface areas are involved. Spray devices in general have been used to coat fences and other such objects. However, sprayers have the inherent disadvantage of uncontrollable spray drift which causes unwanted surface areas to be coated and nearby foliage to be spoiled, particularly when time consuming masking and screening is not in place. Further, spray coats, in general, are very thin and require multiple applications to provide an attractive finish and afford lasting protection from environmental hazards. Sprays have the further disadvantage of running, dripping or sagging when the viscosity of the sprayed composition is not properly adjusted.

The use of manually operated brushes to create the desired coating is very time consuming and expensive. Furthermore, the finished coating sometimes shows brush marks and obtains uneven thickness. Nor is the current use of disposable absorbent mittens for application of the coating compound suitable because the mitten is placed on the hand, submerged in the coating compound, removed and then used to grasp the desired object which is rubbed up and down to apply the coating. Such a method does not yield a uniform coating or coating thickness, causes the loss of excessive coating compound, and is expensive in that it repeatedly requires new mittens to be used. Furthermore, the procedure poses distinct disposal problems because the diposal of the used mittens requires special handling to comply with Environmental Protection Agency regulations.

Roller coating has the advantage of providing a quick, substantially uniform paint application which obviates the need for multiple coats and eliminates brush marks. The finished coating is evenly applied without blemishes. The problem encountered when applying a coating with a roller to a structural surface having a plurality of diverse planes is that the commonly available rollers are basically designed for flat surfaces.

Prior art devices which have developed possible solutions to one or more of the problems envisioned hereby include McLendon (U.S. Pat. No. 2,813,292) which discloses a manually operated roller-type paint applicator which is especially designed to paint cylindrical pipe having two side rollers and a central roller operatively interposed therebetween. Each side roller projects in symmetrically angular relation beyond the ends of the central roller. The axes of rotation of the lateral rollers are adjustable angularly and symmetrically throughout a maximum peripheral arc of 130 degrees thereby suffering limited utility for painting the external surfaces of pipe and planar surfaces or the internal surface of large bore pipe. Furthermore, the complex adjustment of the multiple roller defined therein becomes increasingly difficult as the threaded portions of the adjustment mechanism become encrusted with paint residuum through use.

Schoenfield et al (U.S. Pat. No. 2,896,243) discloses a device for cleaning the slats of so-called venetian blinds which produces simultaneous surface contact of both sides of a single flat member or slat with porous wiping elements capable of retaining suitable cleaning fluid therein.

Schleicher (U.S. Pat. No. 2,904,813) discloses another variation of a paint applying device which comprises a bendable wire having a plurality of absorbent wheels disposed thereon which can be manipulated by the user to encircle the item to be painted. The entire assembly is cumbersome in use and when arranged to encircle the object being painted, it has only a limited range of circumferences with which it can be used.

Leibow (U.S. Pat. No. 3,340,131) discloses another pressure roller laminating device which comprises two fixed parallel rollers on a support frame between which is passed a slab. The rollers exert pressure upon the parallel surfaces of the slab in relation to the angular disposition of the frame with respect to the planar surface of the slab.

Parr (U.S. Pat. No. 3,358,312) discloses a post painter which comprises four rollers mounted on an adjustable frame and disposable to completely encircle the object being painted. However, Parr's frame must be disassembled each time the paint supply for the rollers needs to be replenished. Furthermore, inadequate meshing of the rollers at the corners of the device inevitably results in incomplete paint coverage at the corners of the post surfaces and required brush touch up to complete the project each time it is used. Furthermore, Parr's assembly is restricted to use on square and rectangular shaped posts.

Kierce (U.S. Pat. No. 4,644,604) discloses a device comprising a first and a second roller disposed in spaced parallel relationship to each other on a flexible frame which is responsive to operator applied external pressure to compress the frame and bring the rollers into contact with opposite sides of the object being painted. This assembly lends particularly to early operator fatigue during extended operation.

Accordingly, in spite of the various efforts of the prior art, a need still exists for an improved device for applying coating to objects and things having irregular shapes and/or multiple surfaces in a manner which substantially eliminates the need for both touch-up and clean up thereby enhancing the integrity of the coating and the efficiency of the coating process.

BRIEF SUMMARY OF THE INVENTION

The present invention relates generally to a new and improved device for applying coatings to objects and things having irregular shapes and/or multiple surfaces in a clean, efficient and professional manner.

More particularly, the present invention relates to an improved coating applicator device comprising three coactive rollers strategically mounted on two fixed and one detachable and adjustable support axle. Each roller is detachably mounted over the distal end of each supporting bar and is retained in place between a specially positioned annular flange defined at the proximal end of the support axle and a plastic cap mountable to the distal end of the roller assembly. Each device is equipped with an adjustable hand grip. The adjustable roller is mountable in a preselected position by a mounting bracket.

As will appear, the device embodying the present invention overcomes the problem of roller size and shape by providing a device having a plurality of paint applicators and/or marking applicators which may be readily adjusted to accommodate a variety of interconnecting surfaces for simultaneously painting each of the surfaces. Indeed, the device of the present invention can be used effectively even when those surfaces meet in a corner. The individual rollers can be covered with any suitable material which is effective with the coating composition to be used. Each can be individually matched or diverse, whatever provides the most efficient operation for the situation being addressed. Thus, the coating of an irregular surface might require the use of a long nap roller and the like. Where product coding of bar stock is the desire objective, a roller surface having cylindrical identification stamps embedded therein will be desired.

Accordingly, a prime object of the present invention is to provide a novel and unique paint applicator having the ability to apply a coating to members having a variety of diverse shapes, with or without a plurality of surfaces. Another object of the present invention is to provide a new and improved applicator device capable of rapidly coating large quantities of pipe with relative ease while imparting a uniform contiguous coating thereon.

A further object of the present invention is to provide an improved applicator which is capable of simultaneously and uniformly coating three sides of a box in a single pass.

Still another object of the present invention is to provide a new and improved applicator device of variable configuration.

Still a further object of the present invention is to provide a novel application device which is capable of positioning and printing data, such as product codes or the like, on bar stock and the like.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF PREFERRED EMBODIMENTS

Figure 1:
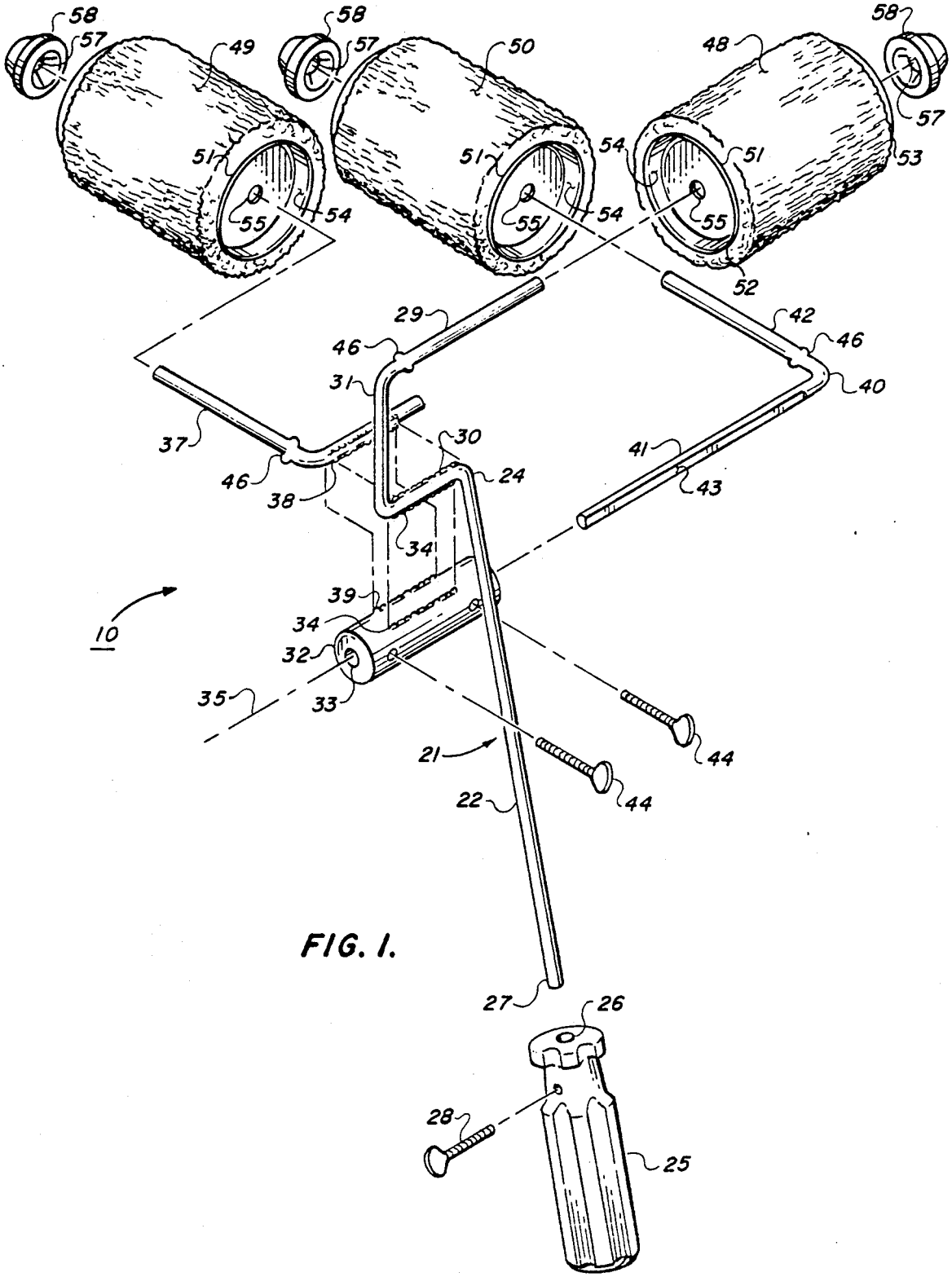
FIG. 1 is an exploded isometric view of a coating applicator device according to the present invention.

Referring to the drawings, the present invention comprises an applicator device identified by the general reference 10. As shown in FIG. one embodiment of device 10 comprises a handle assembly 12 having a first roller mounting assembly 14, a second roller mounting assembly 16, and a third roller mounting assembly 18, strategically mounted thereto in a manner to be hereinafter described in detail.

Handle assembly 12 comprises a strategically shaped rod portion 21 having an elongated shaft portion 22 and a C-shaped portion 23 integrally formed therewith at the distal end 24 of shaft 22. A suitable means 25 having a suitable base 26 defined axially therein is disposed onto the proximal end 27 of shaft portion 22 and telescopically advanced thereon into circumscribing relationship to shaft 22 gripping means 25 is suitably affixed to shaft 22 by detachable securing means 28.

C-shaped portion 23 has an upper arm portion 29 and a lower arm portion 30 disposed in spaced generally parallel relationship to each other and integrally interconnected at a common end thereof by intermediate member 31.

A cylindrical tube 32 having a suitable bore 33 defined axially therethrough concentric with the centerline thereof is disposed in abutting engagement with arm portion 30 and suitably secured thereto as by a weldment 34 for a purpose to be hereinafter described in detail.

A first L-shaped member 36 having an integrally formed arm portion 37 and a base portion 38 is suitably secured to a second surface 39 of lower arm member 30, preferably displaced at about 90° from circumferentially weldment 34 in such a manner that arm portion 37 extends normal outwardly from the vertical plane containing the axial center line 35 of cylindrical tube 32 which base portion 38 extends generally parallel to center line 35.

A second integrally formed L-shaped member 40 having a first arm portion 41 and a second arm portion 42 disposed generally normal to each other, is insertably mounted within the bore 33 of cylindrical tube 32 and rotably adjustable therewithin through a full range of 360° until a desired position is obtained as will be later described in detail. Arm portion 42 is cut or otherwise planed to provide a plurality of planar surfaces 43 which enable arm portion 42 to be secured relative to tube 32 by the tightening of suitable securing means, such as bolts 44, into friction-tight engagement with adjacent surface 43. L-shaped member 40 has another important and highly useful purpose which will hereinafter be described in detail.

The embodiment of the main handle assembly 12 as described above thus comprises an extended handle portion 21 having upper arm portion 29; arm portion 37 of L-shaped member 36 and first arm portion 41 of second L-shaped member 40 protruding outwardly therefrom.

Each of the designated arm portions, such, for example, as arm portion 29, is provided with a circumscribing flange member 46 adjacent its angular juncture with its cooperating portion such, for example, lower arm 30, for a purpose to be hereinafter described.

Device 10 further comprises a plurality of roller members 48, 49, 50, each roller member, for example roller 48, comprising a cylindrical body portion 51 having a first open end 52 and a second open end 53. Each first end 52 and each second end 53 receiving and holding a cylindrical cup member 54 therein, each cup member 54 having an opening 55 defined therethrough in the center thereof in registry with the like opening 55 in its counterpart at the other end thereof. Openings 55 in each roller are aligned to receive its corresponding arm member therethrough to enable the roller to rotate thereupon. Thus, roller 48 is mounted upon arm portion 29 for rotation thereabout, roller 49 is mounted upon arm portion 37 for rotation thereabout, and roller 50 is mounted upon arm portion 41 for rotation thereabout.

The opening 55 in each distal cup member 54 receives its corresponding arm member therethrough for engagement with a friction locking means 57 which is mounted within a dome-shaped cap member 58 associated therewith. Locking means 57 and cap member 58 engages the remote or distal end of the appropriate arm member and coacts with the associated cup member 54 to prevent the separation of the arm member and its associated roller member. For example, 48 when mounted upon arm member 29 through openings 55 and secured in the cup member 54 and secured thereto between flange 46 and cap member 58 comprises first roller assembly 14. Roller 49 when mounted upon arm member 37 and secured thereto between flange 46 and locking means 57 in cap member 58 in the same manner completes second roller mounting assembly 16. Similarly, the sliding placement of roller 50 upon arm member 41 which extends into the roller through opening 53 defined in first cup member 54 and out of the roller through the opening 55 defined in second cup member 54 in secure engagement between flange member 46 and cap member 58 comprises third roller mounting assembly 18.

Figure 2:
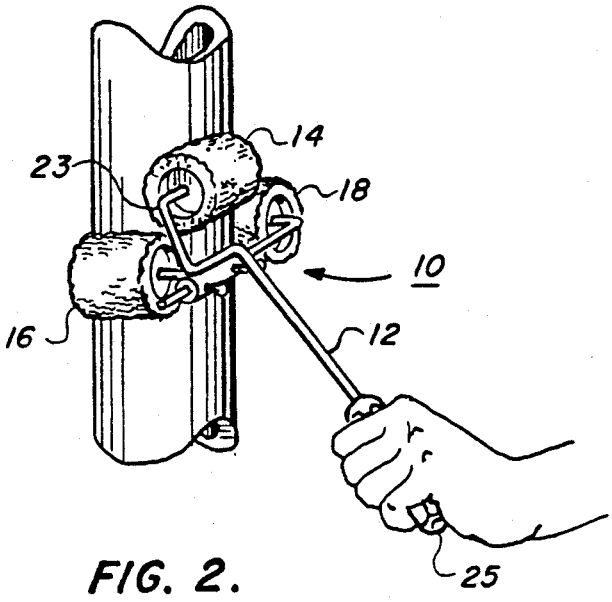
FIG. 2 is an isometric view of the device of FIG. 1 coating round stock.
Figure 4:
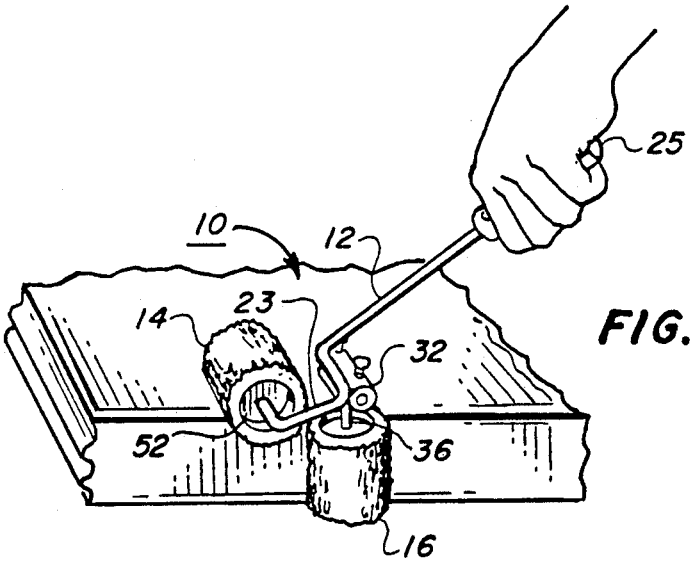
FIG. 4 is an isometric view of another arrangement of the present invention for square coating edges.
Figure 5:
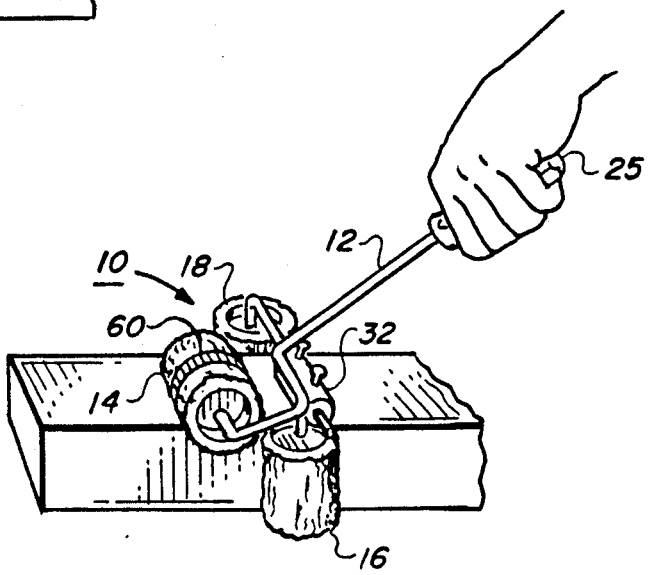
FIG. 5 is an isometric view of still another arrangement of the present invention for simultaneously coating and/or applying product codes on three sides of bar stock.

When assembled as above described, one embodiment of the present invention is created which, as shown in FIGS. 2 and 4, is especially well suited for painting elongated tubular or other irregularly shaped objects by depositing and spreading the desired coating upon three coating areas or surfaces simultaneously. The same assembly, when one roller, such for example as roller 49 in roller assembly 16 is replaced with a print type roller 60, can be used to code or otherwise identify the product which is being simultaneously coated as shown in FIG. 5. As is apparent, the print-type or coding roller 60 can likewise be interchanged with either roller 48 or roller 50 if circumstances warrant that particular location for the coding device or indicia to be emplaced.

Figure 3:
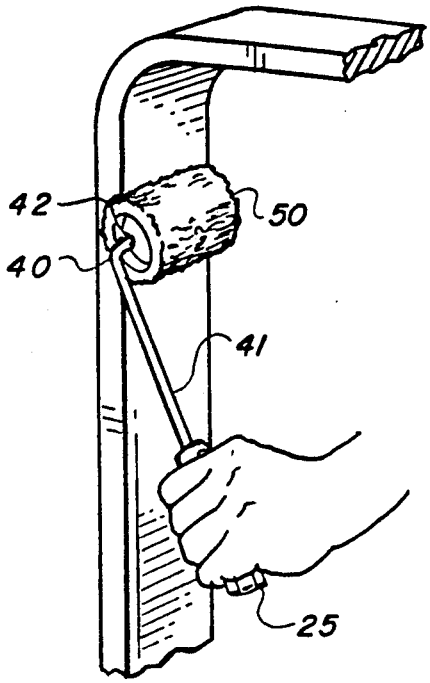
FIG. 3 is an isometric view of an alternative arrangement of the present invention for coating curved flat stock.

Another embodiment of the present invention is shown in FIGS. 3 and 4 and comprises creating two separate hand tools from device 10 by loosening securing means 44 until there is no pressure on arm member 37, withdrawing arm member 37 from its position within cylindrical tube 32 and fitting arm member 37 with an auxially gripping means 23 as shown in FIG. 3, at the free end thereof to provide a speciality tool which is a handy and useful roller means for coating in tight corners and otherwise hard to reach places. The tool remaining, after the second roller assembly 16 including arm member 37 is removed from device 10, is shown in FIG. 4 and comprises another speciality tool for covering adjacent exterior edges of a right angle juncture. One speciality tool, as described, contains two independent rollers and is characterized as a "bi-roller applicator". The other speciality tool described contains one independent roller and is characterized as a "mono-roller applicator".

It is of course understood that the position of roller assembly 16 relative to roller assemblies 14 and 18 is also angularly adjustable by loosening bolts 44 and rotating arm member 37 within tube 32 until a different surface 39 is facing toward bolts 44 and thereafter tightening the bolts 44 to secure arm member 37 in its newly selected position.

After use, device 10 is readily cleaned by removing the several cap members 58 from each roller mounting assembly 14, 16, 18, removing the respective rollers 48, 49, 50 from the respective arm members 29, 37, 41 and washing the rollers in an appropriate solvent. If necessary, handle assembly 12 is cleaned by wiping its several surfaces with a soft rag which, if needed, is soaked in a suitable solvent. It should be noted that the cleaning of paint, oil and ink applicators is already well known in the art and it is not intended that the present invention be limited to any particular cleaning scheme.

From the foregoing, it becomes apparent that new and useful procedures have been herein described and illustrated which fulfill all of the aforestated objectives in a remarkably unexpected fashion. It is of course understood that such modifications, alterations and adaptations as may readily occur to an artisan having the ordinary skills to which this invention pertains are intended within the spirit of the present invention which is limited only by the scope of the claims appended hereto.

Accordingly what is claimed is:

1. A device for applying coatings to objects having irregular shapes and/or diverse surfaces comprising: a handle assembly, said handle assembly, said handle assembly having a elongated rod portion having a proximal and distal end, a C-shaped portion integrally formed with said rod portion at said distal end thereof, and a detachable gripping means telescopically mountable on said proximal end of said rod portion; a first roller mounting assembly integrally formed with said handle assembly and including means adapted to receive a removable first roller means thereupon for rotational movement thereabout; a second roller mounting assembly integrally secured to said handle assembly and extending generally normal therefrom, said second roller mounting assembly comprises a L-shaped member having an outreaching arm portion and a base portion, said base portion being integrally secured to said lower arm portion of said C-shaped portion, said outreaching arm portion extending generally perpendicular to said base portion and having an annular flange disposed on the proximal end thereof and friction locking means attachable to the distal end thereof for securing one of said roller means between said proximal and said distal end in operative relationship on said outreaching arm portion; a third roller mounting assembly detachably secured to said handle assembly in an angularly adjustable relationship thereto and including means adapted to receive a removable third roller means thereupon for rotational movement thereabout; and a plurality of roller means, one being detachably secured to each one of said roller mounting assemblies.

2. A device according to claim 1 in which said first roller mounting assembly comprises an elongated arm member having an annular flange disposed thereabout adjacent one end thereof and a friction locking means operatively associated with the other end thereof for securing said roller means therebetween; said elongated arm member being integrally formed with said handle assembly.

3. A device according to claim 2 in which said friction locking means are disposed within and integrally formed with a domed cap member.

4. A device according to claim 1, in which said C-shaped portion comprises an upper arm portion and a lower arm portion disposed in spaced generally parallel relationship to each other and an intermediate portion intimately interconnected between an end of said upper arm portion with a corresponding end of said lower arm portion and extending generally normal therebetween, said upper arm portion having an annular flange disposed thereupon adjacent said intermediate portion and friction locking means operatively associated with the other end thereof and coacting with said annular flange to secure one of the said roller means for rotation therebetween.

5. A device according to claim 4 in which said second roller mounting assembly comprises a L-shaped member having an outreaching arm portion and a base portion, said base portion being integrally secured to said lower arm portion of said C-shaped portion, said outreaching arm portion extending generally perpendicular to said base portion and having an annular flange disposed on the proximal end thereof and friction locking means attachable to the distal end thereof for securing one of said roller means between said proximal and said distal end in operative relationship on said outreaching arm portion.

6. A device according to claim 5 in which said third roller mounting assembly comprises an L-shaped member having a first arm portion and a second arm portion, said first arm portion and said second arm portion being integrally formed and disposed at right angles to each other, said first arm portion having a plurality of planar surfaces defined thereupon and operable to position said second arm portion relative to said handle assembly, said second arm portion including means for receiving open of said roller means thereupon for rotation thereabout while restrained in its axial movement therealong.

7. A device according to claim 6 in which each said roller means comprises a cylindrical member having a first and a second open end, a first and second cylindrical cup member, one said cup member being operatively installed in each one of said open ends and having an opening defined centrally therethrough to receive said roller mounting assembly therewithin to define an axis of rotation therefor.

8. A device according to claim 5 in which each said roller means comprises a cylindrical member having a first and a second open end, a first and second cylindrical cup member, one said cup member being operatively installed in each one of said open ends and having an opening defined centrally therethrough to receive said roller mounting assembly therewithin to define an axis of rotation therefor.

9. A device according to claim 4 in which said third roller mounting assembly comprises an L-shaped member having a first arm portion and a second arm portion, said first arm portion and said second arm portion being integrally formed and disposed at right angles to each other, said first arm portion having a plurality of planar surfaces defined thereupon and operable to position said second arm portion relative to said handle assembly, said second arm portion including means for receiving one of said roller means thereupon for rotation thereabout while restrained in its axial movement 10. A device according to claim 4 in which each of said roller means comprises a cylindrical member having a first and a second open end, a first and second cylindrical cup member, one said cup member being operatively installed in each one of said open ends and having an opening defined centrally therethrough to receive said roller mounting assembly therewithin to define an axis of rotation therefor.

11. A device according to claim 1 having a cylindrical tube integrally secured to said handle assembly for receiving said third roller mounting assembly therewithin and selectively positioning said third roller mounting assembly relative thereto.

12. A device according to claim 1 in which said third roller mounting assembly comprises an L-shaped member having a first arm portion and a second arm portion, said first arm portion and said second arm portion being integrally formed and disposed at right angles to each other, said first arm portion having a plurality of planar surfaces defined thereupon and operable to position said second arm portion relative to said handle assembly, said second arm portion including means for receiving one of said roller means thereupon for rotation thereabout while restrained in its axial movement therealong.

13. A device according to claim 12 in which said friction locking means are disposed within and integrally formed with a domed cap member.

14. A device according to claim 1 in which each said roller means comprises a cylindrical member having a first and a second open end, a first and second cylindrical cup member, one said cup member being operatively installed in each one of said open ends and having an opening defined centrally therethrough to receive said roller mounting assembly therewithin to define an axis of rotation therefor.

15. A device according to claim 1 in which said third roller mounting assembly is detachably secured to from said handle means and removable therefrom to provide an independent roller applicator, said handle means then supporting a first and second roller means disposed at right angles to each other and capable of simultaneously coating conjoined surfaces of an exterior right angle.

16. A device according to claim 1 in which said friction locking means are disposed within and integrally formed with a domed cap member.

17. A device for applying coatings to irregular surfaces comprising: a handle assembly having an elongated rod portion having a proximal and a distal end, a C-shaped portion integrally formed with said rod portion at said distal end thereof, and a detachable gripping means telescopically mounted upon said proximal end of said rod portion in circumscribing relationship thereto; a first roller mounting assembly integrally formed with said handle assembly and adapted to receive a first roller means thereupon for rotational movement relative thereto, said first roller mounting assembly having an elongated arm member having a first and a second end, said first end having an annular flange disposed adjacent thereto in circumscription thereabout, and friction locking means operatively associated with said second end and coactive with said annular flange to secure said first roller means therebetween for rotation on said elongated member; a second roller mounting assembly integrally secured to said handle assembly and extending generally normal therefrom, said second roller mounting assembly having a L-shaped member having an outreaching arm portion and a base portion, said base portion being integrally secured to said C-shaped portion, said arm portion extending generally perpendicular outwardly from said base portion to a distal end portion and having an annular flange circumscribed thereabout adjacent said base portion, and friction locking means attachable to said distal end thereof and coactive with said annular flange to secure said roller means therebetween for rotation on said arm portion; a cylindrical tube integrally secured to said handle assembly for receiving and detachably securing a third roller mounting assembly therewithin for selective positioning relative thereto; a third roller mounting assembly detachably secured to said cylindrical tube and adjustable relative thereto, said third roller mounting assembly having an L-shaped member having a first arm portion and a second arm portion, said second arm portion being integrally formed with said first arm portion and extending generally normal therefrom to a distal end, said first arm portion having a plurality of planar surfaces defined thereupon and coactive to position said second arm portion relative to said handle assembly, said second arm portion having an annular flange disposed thereabout adjacent said first arm portion, and friction locking means operatively associated with said distal end and coactive with said annular flange to secure a roller means therebetween for rotation on said second arm portion; and a plurality of cylindrically shaped roller means one being secured to each one of said roller mounting assemblies, each said cylindrical roller means having a first open end and a second open end, a first and second cylindrical cup member, one of said cylindrical cup members being operatively installed in each of said open ends and having an opening defined centrally therethrough to receive a corresponding one of said arm members therewithin for rotation on the axis of rotation defined thereby, one of said cup members abutting said annular flange to restrict the axial movement of said roller means on said arm member, said corresponding friction locking means engaging said second cup member to prevent the removal of said roller means from said corresponding arm member.

* * * * *